United States Patent [19]

Grosemans

[11] 4,356,594

[45] Nov. 2, 1982

[54] FRICTION HINGE HAVING A BALANCING SPRING

[75] Inventor: Jozef A. Grosemans, Eindhoven, Netherlands

[73] Assignee: U.S. Philips Corporation, New York, N.Y.

[21] Appl. No.: 303,313

[22] Filed: Sep. 17, 1981

Related U.S. Application Data

[63] Continuation of Ser. No. 120,412, Feb. 11, 1980, abandoned.

[30] Foreign Application Priority Data

Feb. 13, 1979 [NL] Netherlands ..... 7901121

[51] Int. Cl.[3] ..... E05D 11/06

[52] U.S. Cl. ..... 16/256; 16/289; 16/307; 16/342; 16/347; 220/335

[58] Field of Search ..... 16/255, 256, 277, 278, 16/280, 285, 289, 292, 297, 300, 304, 306, 307, 319, 333, 337, 342, 343, 347, DIG. 13, DIG. 29; 220/335

[56] References Cited

U.S. PATENT DOCUMENTS

| | | | |
|---|---|---|---|
| 3,426,387 | 2/1969 | Bitney | 16/300 |
| 4,007,513 | 2/1977 | Zernig | 16/333 |
| 4,193,164 | 3/1980 | Okayama | 16/307 X |

*Primary Examiner*—Howard N. Goldberg
*Assistant Examiner*—Fred A. Silverberg
*Attorney, Agent, or Firm*—David R. Treacy

[57] ABSTRACT

A friction hinge arrangement for the hinged connection of a cover to a base, for example a record player base, comprises a hingeable friction member, which is mounted between the limbs of a friction member whose limbs are urged towards each other with the aid of clamping members. In order to minimize the maximum moments to be exerted when the cover is opened and closed the friction hinge arrangement is provided with a spring which biases the hinge pin and partly compensates for the force of gravity acting on the cover.

3 Claims, 5 Drawing Figures

FRICTION HINGE HAVING A BALANCING SPRING

This is a continuation of application Ser. No. 120,412, filed Feb. 11, 1980, now abandoned.

BACKGROUND OF THE INVENTION

The invention relates to a friction hinge arrangement for the hinged connection of a cover to a base, for example of a record player, the cover being movable relative to the base between a closed and an open position and being retainable in the open position and in any other position between the closed and the open position with the aid of forces in the friction hinge which counteract the force of gravity on the cover, the arrangement comprising: a hinge member which is movable about a hinge axis between a first position, corresponding to the closed position of a cover, and a second position, corresponding to the open position of a cover, which member has a cylindrical portion which functions as hinge pin and a connection portion which serves for connection to a cover; a plastic friction member which takes the form of a roughly strip-shaped part which is doubled over and which thus comprises two roughly strip-shaped limbs which are interconnected at a bend, the two limbs extending substantially parallel to spaced from each other, and recesses being formed in the limbs at the bend for lodging the hinge pin between the limbs; as well as clamping members for urging the limbs of the friction member towards each other and thus clamping the hinge pin between the limbs.

This type of friction hinge arrangement is used extensively, especially for the hinged connection of transparent plastic covers to record player bases. The arrangement is small and cheap. Securing the arrangement to the base and the cover is simple. For this purpose each of the friction hinge arrangements is secured to the back of the base with the aid of two bolts, which also serve as clamping members for urging the limbs of the friction member towards each other. The hinge members are substantially hook-shaped, one of the limbs of the hook serving as hinge pin and the other limb serving to secure the cover. This connection portion has a cylindrical shape. At its back the plastic cover has two thickened portions, which are each formed with a cylindrical opening in which the cylindrical connections portion of the hinge member is inserted. Thus, a simple step-on operation suffices to attach the cover to the base.

The friction hinge arrangements described in the foregoing owe their popularity to the fact that an important requirement which is imposed in respect of the operation of record players is thus met by simple means. This requirement is that preferably a user can place the cover in any position between its closed and its open position without the cover dropping back into its closed position when it is released. This may not only damage the cover itself, but parts of the record player which are sensitive to shocks may be damaged as well. This is especially so for the bearing of the turntable and the pick-up arm, as well as for the pick-up arm itself and the pick-up element. Moreover, if the cover should drop from an open position when a record is being played, the record is also likely to be damaged.

It is considered a drawback of the known friction hinge arrangement that comparatively great friction forces must be produced in the friction hinges to ensure that the cover remains in its open position even in the most unfavorable situation.

SUMMARY OF THE INVENTION

The object of the invention is to provide a friction hinge which is simple, reduces the likelihood of a partially open cover dropping to the closed position, and yet requires less effort for opening and closing the cover.

To this end the invention is characterized in that the friction hinge arrangement comprises resilient means for exerting a resilient compensation moment on the hinge member in a direction towards its second position, which corresponds to the open position of a cover, so as to partly compensate for the force of gravity to which a cover is subject. As is explained in more detail in the description (FIG. 5), a substantial reduction of the effort required for the operation of the cover can be obtained by a suitable choice of the spring characteristic of the resilient means in relation to the friction torque of the hinges.

A suitable embodiment of the invention is characterized in that the resilient means comprise a wire spring which is helically wound around a part of the hinge pin and which has a first free end and a second free end; that the hinge pin is formed with an opening which extends transversely to the hinge axis; that the first free end of the wire spring is lodged in the opening in the hinge pin; and that the second free end is disposed at some distance from the hinge pin and serves to transmit spring forces. This provides a compact construction of the friction hinge arrangement in accordance with the invention, so that the external dimensions of the arrangement need not be greater than those of the previously mentioned known friction hinge arrangement. For transmission of the spring forces the second end of the spring can bear against that limb of the friction member which faces the base to which the arrangement is attached or against the base itself.

For a simple mounting a further preferred embodiment, is characterized in that the hinge pin, in a manner known per se, has the same diameter (that is, it is circular cylindrical) over its entire length and has a free end which is remote from the connecting member; that the opening in the hinge pin is formed by a slot which extends from the free end of the hinge pin transversely to the hinge axis and which has a width which, apart from a slight tolerance, is substantially equal to the diameter of the wire from which the wire spring is manufactured; and that the friction member is formed with two bends and a space between them for lodging the wire spring and for preventing axial movement of the spring, so that the friction hinge arrangement can be mounted by first fitting the wire spring into the recess, subsequently inserting the hinge pin between the limbs of the friction member in the direction of the hinge axis, and finally slipping the wire spring onto the hinge pin, fitting the first free end of the wire spring into the slot in the hinge pin.

In order to minimize the forces to be exerted on the cover, it is advantageous to use an embodiment of the invention, which is characterized in that the resilient compensation moment exerted by the resilient means in an intermediate position ($\alpha=\alpha_2$) of the cover which is situated nearer its open position ($\alpha=90°$), has a value equal to zero and between the intermediate position and the open position of the cover acts on the hinge member in a direction towards its first position, which corresponds to the closed position ($\alpha=0°$) of the cover.

BRIEF DESCRIPTION OF THE DRAWING

The invention is described in more detail with reference to the drawing, in which.

DESCRIPTION OF THE PREFERRED EMBODIMENT

Figure 1:
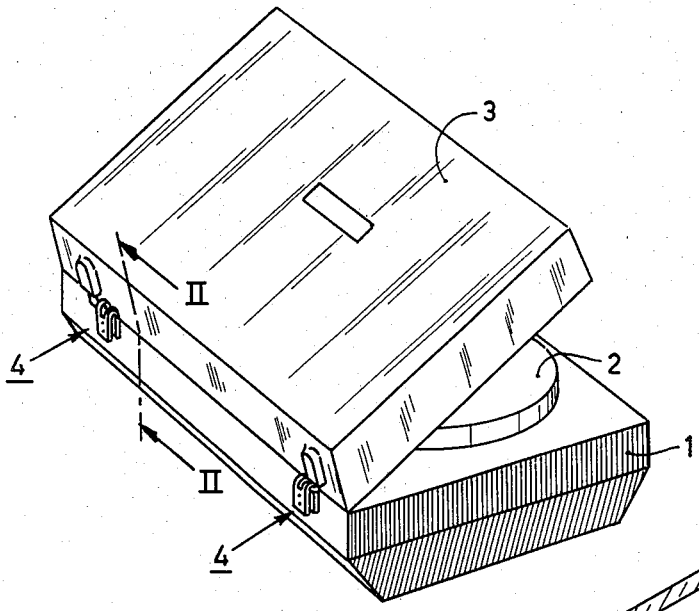
FIG. 1 is a perspective rear view of a record player comprising a transparent plastic cover, which is attached to a base by means of two friction-hinge arrangements in accordance with the invention.
Figure 2:
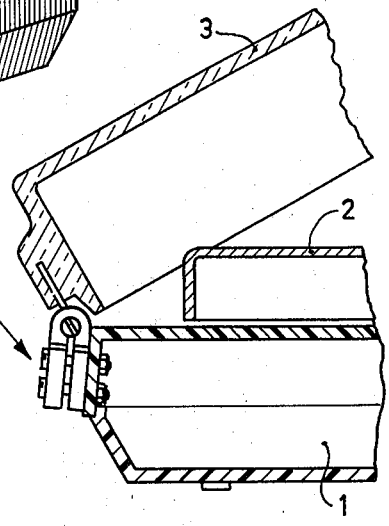
FIG. 2 is a cross-section of a cover of the record player of FIG. 1, viewed in the direction of the arrows II—II in FIG. 1.

The record player in accordance with FIG. 1 comprises a base 1 on which a turntable 2 is journalled. A transparent plastic cover 3 is hinged to the base with the aid of two friction-hinge arrangements 4.

Figure 3:
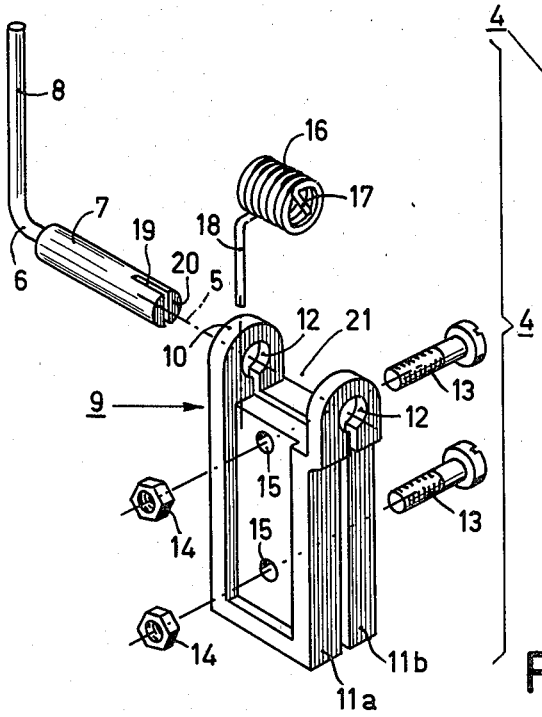
FIG. 3 is an exploded view of a friction hinge arrangement in accordance with the invention, FIG. 4 schematically represents forces and moments acting on the cover of the record player of FIG. 1, and FIG. 5 graphically represents the moments to be exerted by a user for opening and closing the cover, with or alternatively without the use of the invention.

The friction hinge arrangement 4 comprises, see in particular FIG. 3, a hinge member 6 which is movable about a hinge axis 5 between a first position, corresponding to the closed position of the cover 3, and a second position, corresponding to the open position of the cover 3. The hinge member comprises a cylindrical portion which functions as hinge pin 7 and a connection portion in the form of a connecting pin 8 for the cover. There is also provided a friction member 9, which is manufactured from a plastic, for example poly-acetal, and which takes the form of a roughly strip-shaped part which is doubled over and thus comprises two roughly strip-shaped limbs 11*a* and 11*b* which are interconnected at a bend 10, the two limbs extending substantially parallel to and spaced from each other. At the bend recesses 12 are formed in the limbs for lodging the hinge pin 7. For urging the limbs 11*a* and 11*b* of the friction member towards each other and thus clamping the hinge pin 7 between the limbs there are provided clamping members in the form of two bolts 13 and 14. The bolts are passed through the openings 15 in the limbs 11*a* and 11*b* and, apart from urging the limbs towards each other, they also serve for securing the friction member 9 to the base 1 of the record player. The friction hinge arrangement furthermore comprises the resilient means 16 for resiliently loading the hinge members 6 in a direction towards its second position, which corresponds to the open position of the cover 3, so as to partly compensate for the force of gravity to which the cover is subject.

The resilient means 16 comprise a wire which is helically wound around a part of the hinge pin 7 and which has a first free end 17 and a second free end 18. The hinge pin 7 is formed with an opening 19 which extends transversely to the hinge axis 5. The first free end 17 of the wire spring 16 is lodged in the opening 19 in the hinge pin 7 and the second free end 18 is disposed at some distance from the hinge pin 7 and serves to transmit spring forces to the base 1. The hinge pin 7 is a circular cylinder over its entire length and has a free end 20 on its side which is remote from the connection pin 8. The opening 19 in the hinge pin is formed by a slot 19 which extends from the free end 20 of the hinge pin 7 transversely to the hinge axis 5 and has a width which, apart from a slight tolerance, is substantially equal to the diameter of the wire from which the wire spring 16 is manufactured. Near the bend 10 the friction member 9 is formed with a recess 21 for lodging the wire spring and for preventing an axial movement of the spring. The friction hinge arrangement can be mounted by first fitting the wire spring 16 into the recess 21, subsequently inserting the hinge pin 7 between the limbs 11*a* and 11*b* of the friction member 9 in the direction of the hinge axis 5, and finally slipping the wire spring 16 onto the hinge pin 7, fitting the first free end 17 of the wire spring into the slot 19 of the hinge pin.

FIG. 3 shows the wire spring 16 in an unstressed condition. The free end 18, which serves for the transmission of spring forces to the base 1, bears either against the limb 11*a* or against the base 1, depending on the position of the cover 3.

The substantial reduction of the effort required for opening and closing the cover 3 by the use of the friction hinge arrangement in accordance with the invention is explained with reference to FIGS. 4 and 5.

Figure 4:
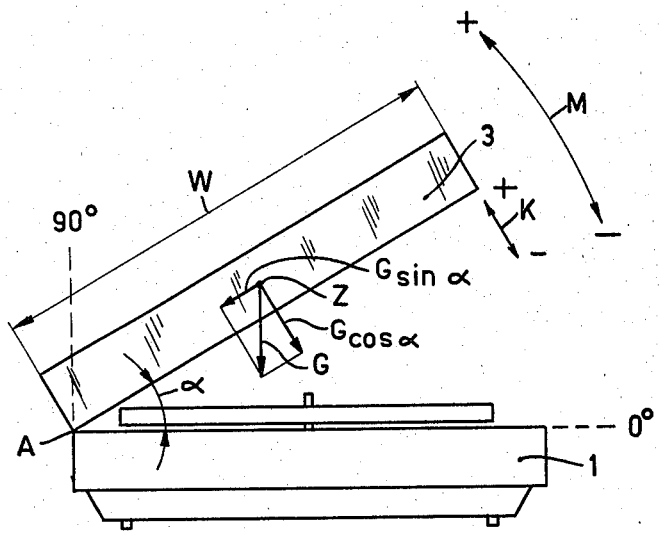

FIG. 4 shows a force diagram for the record player of FIG. 1. The force of gravity G acting on the cover 3 owing to its weight acts through the center of gravity Z. The force G may be resolved into a force G cos $\alpha$ perpendicular to the top and bottom side of the cover 3 and a force G sin $\alpha$ in a direction perpendicular thereto. The figure shows that the angle $\alpha$ is 0° in the closed position of the cover and is 90° in the open position of the cover. In order to open the cover the user can exert a force K on the front of said cover, which force is assumed to be positive if the force acts in such a direction that a torque is exerted on the cover in a counterclockwise direction and is further assumed to be negative in the opposite direction. This is symbolized by a"+" and a"−" on either side of the letter K. The drawing moreover shows the width W of the cover between its front and its back. All moments M are assumed to be positive in a counterclockwise direction and negative in the opposite direction. The two axes for $\alpha=0°$ and $\alpha=90°$ intersect in point A. In the case of a standard record player the mass of the cover 3 may for example be 750 grams. The force G is then 7.5 newtons. The dimension W may for example be 0.33 meters.

Figure 5:
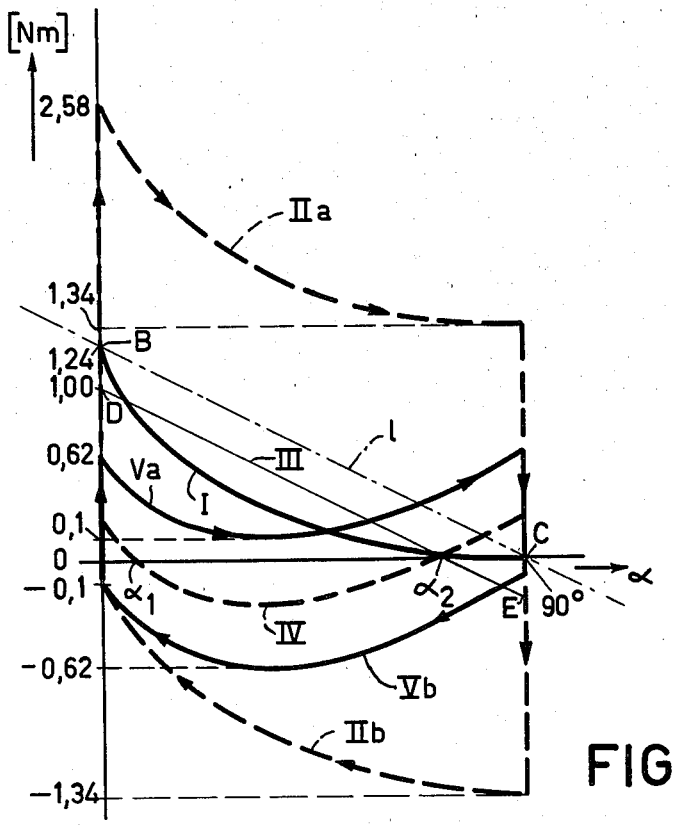

FIG. 5 is a graph of torque versus cover position, the angle $\alpha$ in degrees between 0° and 90° being plotted on the horizontal axis and the vertical axis being graduated in Newton meters for plotting moments. The moment about the point A exerted on the cover by the force G is $G \cos \alpha \times \frac{1}{2}W = 1.24 \cos \alpha$[Nm]. Curve I in FIG. 5 represents the moment to be exerted on the cover 3 to open the cover when solely the force of gravitation G acts on the cover. This moment varies from 1.24 Nm when the cover is closed to 0 Nm when the cover is fully open. When a friction hinge arrangement is used of the previously discussed known type, i.e. one not provided with resilient means, the moment required for opening the cover is increased by a friction moment produced in the friction hinges. If it is assumed that the friction moment should have such a magnitude that under no circumstances will the cover 3 drop under the influence of the force G, a small negative moment would still have to be exerted when the cover is closed (i.e., in the position $\alpha=0°$). This means that the friction moment produced in the friction hinge arrangements should be slightly greater than 1.24 Nm, for example 1.34 Nm. The moments required for opening and closing the cover under the conditions thus obtained are represented by the curves II*a* and II*b* respectively in FIG. 5. In this respect it is to be noted that, in respect of its absolute value, the friction moment occurring as the cover is moved is independent of the opening angle $\alpha$ and its sign changes when the direction of movement of the cover is reversed. As is apparent from FIG. 5 the required maximum moment for opening the cover increases from 1.24 Nm to 2.58 Nm. For closing the cover a negative closing moment is required which varies from 1.34 Nm to −0.1 Nm. The arrows in FIG. 5 indicate in which direction the curves II*a* and II*b* are followed when the cover 3 is opened and closed respectively.

The resilient means of the friction hinge arrangement in accordance with the invention can readily be given a linear characteristic, i.e. such a characteristic that the magnitude of the moment exerted by the springs varies as a linear function of the angle $\alpha$. FIG. 5 shows how an optimum spring characteristic can be chosen. Through the points B and C at the ends of the curve I the straight dash-dot line 1 is drawn. A straight line III is drawn parallel to the line 1 in such a way that the distances between the ends D and E of this line and the points B and C respectively of the line 1 are equal to the maximum distance between the line III and the part of the curve I situated below that line. The curve III represents the characteristic of the moment exerted on the cover III by the resilient elements of the friction hinge arrangements. The curve IV is the difference between the curve I and the line III and graphically represents the moment to be exerted on the cover 3 for opening the cover with the aid of the resilient means but in the absence of friction moments. By the choice just mentioned of the location of the straight line III the curve IV has a minimum which is situated as far below the $\alpha$-axis as the two marginal maxima at the location of 0° and 90° are situated above the $\alpha$ axis. In order to open the cover a positive moment should be exerted between $\alpha=0°$ and an angle $\alpha_1$, after which between $\alpha_1$ and $\alpha_2$ the cover should be retained, i.e. a negative moment should be exerted. When $\alpha_2$ is reached at an intermediate position situated nearer the open position of the cover, the moment has again become zero, after which once more a positive moment should be exerted until the position $\alpha=90°$ is reached. If in this case also the requirement is imposed that a friction moment is to be exerted by the friction members such that when the cover is opened a minimum positive moment should be exerted on the cover of 0.1 Nm, a curve Va is obtained for opening the cover and a curve Vb for closing the cover. The curve Va has a maximum of 0.62 Nm and the curve Vb a minimum of −0.62 N. Apart from being considerably smaller than the values associated with the curves II*a* and II*b*, the values now obtained are symmetrical.

As is demonstrated by FIG. 5 the use of the invention leads to a reduction by a factor 4 of the maximum moment to be exerted when opening the cover.

The friction hinge arrangement in accordance with the invention may also be employed in other equipment and devices than record players, such as in magnetic tape apparatus, kitchen ranges, furniture, etc.

What is claimed is:

1. A friction hinge arrangement for connecting a cover to a base, such as in a record player, the cover being pivotal relative to the base between a closed and an open position and being retainable in the open or any other position between the closed and open positions by friction forces in the hinge, which counteract the force of gravity tending to close the cover, comprising a plastic friction member formed as a strip-shaped part which is doubled over to form two strip-shaped limbs interconnected by a bend, the limbs being substantially parallel to and spaced from each other, recesses being formed in the limbs at the bend to define a hinge axis, a hinge member having a cylindrical portion which functions as a hinge pin, disposed in said recesses, and a connection portion for connection to a cover, said hinge member being movable about the hinge axis between a first position corresponding to the closed position of the cover, and a second position corresponding the the open position of the cover, and clamping members for urging the limbs of the friction member toward each other and thus clamping the hinge pin between the limbs, characterized in that the hinge pin is formed with an opening extending transversely to the hinge axis, and the hinge comprises a wire spring helically wound around a part of the hinge pin, said spring having a first free end and a second free end, the first free end being lodged in the transverse opening of the hinge pin, and the second free end being disposed at some distance from the hinge pin and arranged to transmit spring forces for exerting a resilient compensation moment on the hinge member in a direction toward its second position, corresponding to the open position of the cover, so as to compensate partly for the force of gravity on the cover.

2. A hinge as claimed in claim 1, characterized in that the hinge pin is circular cylindrical over its entire length and has a free end remote from the connecting member, that the opening in the hinge pin is formed by a slot extending from the free end of the hinge pin and has a width which is substantially equal to the diameter of the wire forming the wire spring, and the friction member has two bends defining a space between them for lodging the wire spring and preventing axial movement of said spring, so that the hinge can be assembled by first fitting the wire spring into the space, then inserting the hinge pin into the recesses at the bends, by movement along the direction of the hinge axis and through the spring, and finally fitting the first free end of the wire spring into the slot in the hinge pins.

3. A hinge as claimed in claim 1, characterized in that the resilient compensation moment exerted by the spring in an intermediate position of the cover nearer the open position of the cover has a value equal to zero, and between said intermediate position and the open position of the cover acts on the hinge member in a direction toward the first position which corresponds to the closed position of the cover.

* * * * *